United States Patent [19]

Bloom

[11] 4,069,008

[45] Jan. 17, 1978

[54] METHOD AND APPARATUS FOR HEATING A WORKPIECE

[75] Inventor: William M. Bloom, Pittsburgh, Pa.

[73] Assignee: Allegheny Ludlum Industries, Inc., Pittsburgh, Pa.

[21] Appl. No.: 668,570

[22] Filed: Mar. 19, 1976

[51] Int. Cl.[2] ..... F27B 9/28

[52] U.S. Cl. ..... 432/8; 432/18; 432/59; 432/164

[58] Field of Search ..... 432/8, 59, 83, 18, 164

[56] References Cited

U.S. PATENT DOCUMENTS

| | | | |
|---|---|---|---|
| 2,792,206 | 5/1957 | Wagner | 432/8 |
| 3,186,694 | 6/1965 | Beggs | 432/8 X |
| 3,222,042 | 12/1965 | Fritz | 432/8 X |
| 3,837,794 | 9/1974 | Phillips | 432/8 |
| 3,841,614 | 10/1974 | Okuno | 432/164 |

*Primary Examiner*—John J. Camby

*Attorney, Agent, or Firm*—Vincent G. Gioia; Robert F. Dropkin

[57] ABSTRACT

A steel strip such as stainless steel is passed in uncoiled form through a jet recuperator, an intermediate furnace section, and a main fired furnace section in which a fuel such as natural gas is burned. The exit end of the main furnace section has an opening only slightly greater than the cross-section of the strip. The strip is preheated in the jet recuperator by forcing waste gases from top and bottom waste gas chambers through holes in the bottom and top, respectively, of the waste gas chambers against both sides of the strip. The strip is further heated by the waste gases in the unfired intermediate section and brought to final temperature in the main fired section.

14 Claims, 9 Drawing Figures

METHOD AND APPARATUS FOR HEATING A WORKPIECE

This invention relates to the heating of a workpiece and more particularly to the heating of steel strip which passes continuously through a gas fired annealing furnace. Prior to my invention the strip was being heated in a side fired furnace using natural gas with the products of combustion or waste gases being exhausted to the atmosphere at both ends of the furnace at high temperature. This, of course, was inefficient.

The efficiency of heating furnaces of this type or of various other types of furnaces may be increased in several ways. The waste gases may be used in a regenerator or recuperator to heat the combustion air and in some instances the fuel. Regenerators require at least two chambers with reversal of flow required at relatively short intervals such as 15 minutes. The problems involved are such that regenerators are seldom used today except where necessary because of the high waste gas temperatures such as in steel producing open hearth furnaces. Recuperators utilize metal or ceramic heat exchangers and have inherent heat losses. They are relatively inefficient because the heat must be transferred from the waste gases through the metal or ceramic to the combustion air.

The waste gases may be used to heat boilers which make efficient use of the heat in the waste gases. However, there are many instances when there is no practical use for the generated steam and in all instances the amount of fuel required is not reduced.

In some instances the waste gas heat may be used in other processes, but such processes are not often available and, where available, some heat is lost in transmission.

In some instances the waste gases are used in some manner to preheat the workpiece. One such furnace of which I have knowledge is a slab heating such as shown in FIG. 22–11 on Page 668 of the Ninth Edition of The Making, Shaping and Treating of Steel. In this furnace there are three heating zones with the burners being located at the discharge end of the furnace and directed toward the entry end. Most of the waste gases pass out through the entry end of the furnace and preheat the slab. This reduces the fuel required, but has several disadvantages. A long and costly preheat section is required due to the decreasing influence of radiation in the lower temperature ranges of the waste gases and the low velocity of the waste gases for convection heat transfer. In addition, the bouyancy of the hot waste gases causes them to flow upward and along the roof of the furnace entry preheat vestibules causing the furnace hearths to be colder than the roofs. Also, loss of internal furnace pressure control will result as the higher temperature waste gases of the roof area exit the furnace and rise upward in the atmosphere outside the furnace causing inspiration of additional waste gases from the furnace with the result that cold, dense air will enter the furnace along its hearth and pull heat from the preheated slab and higher temperature waste gases, thereby reducing the longer vestibule heat transfer efficiency.

In existing installations space available at the entry end of the furnace is seldom sufficient to install an extension of sufficient length to recover a large percentage of the heat in the waste gases.

It is therefor an object of my invention to provide apparatus for heating a workpiece which efficiently recovers a large precentage of the heat in the waste gases.

Another object is to provide such apparatus which requires a relatively small space.

Still another object is to provide such apparatus which may be readily added to an existing furnace.

A further object is to provide an efficient method of heating a steel strip passing in uncoiled form through a furnace.

These and other objects will be more apparent after referring to the following specification and attached drawings in which.

Figure 2:
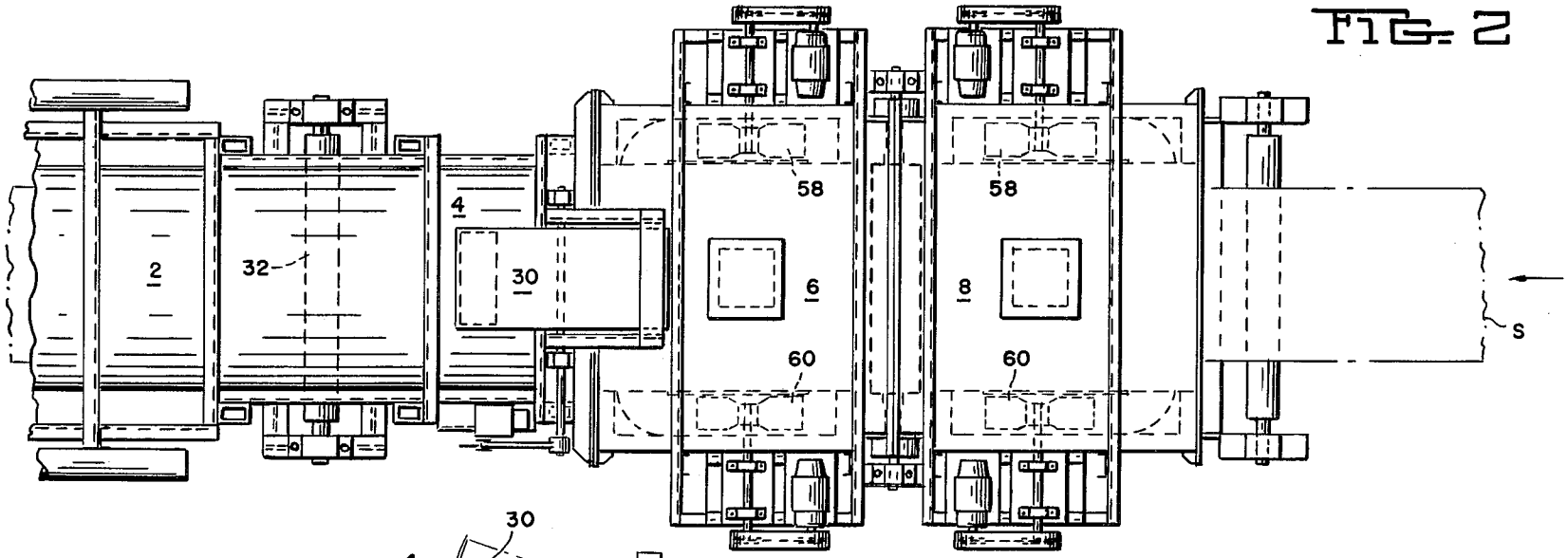
FIG. 2 is a plan view of FIG. 1.
Figure 1:
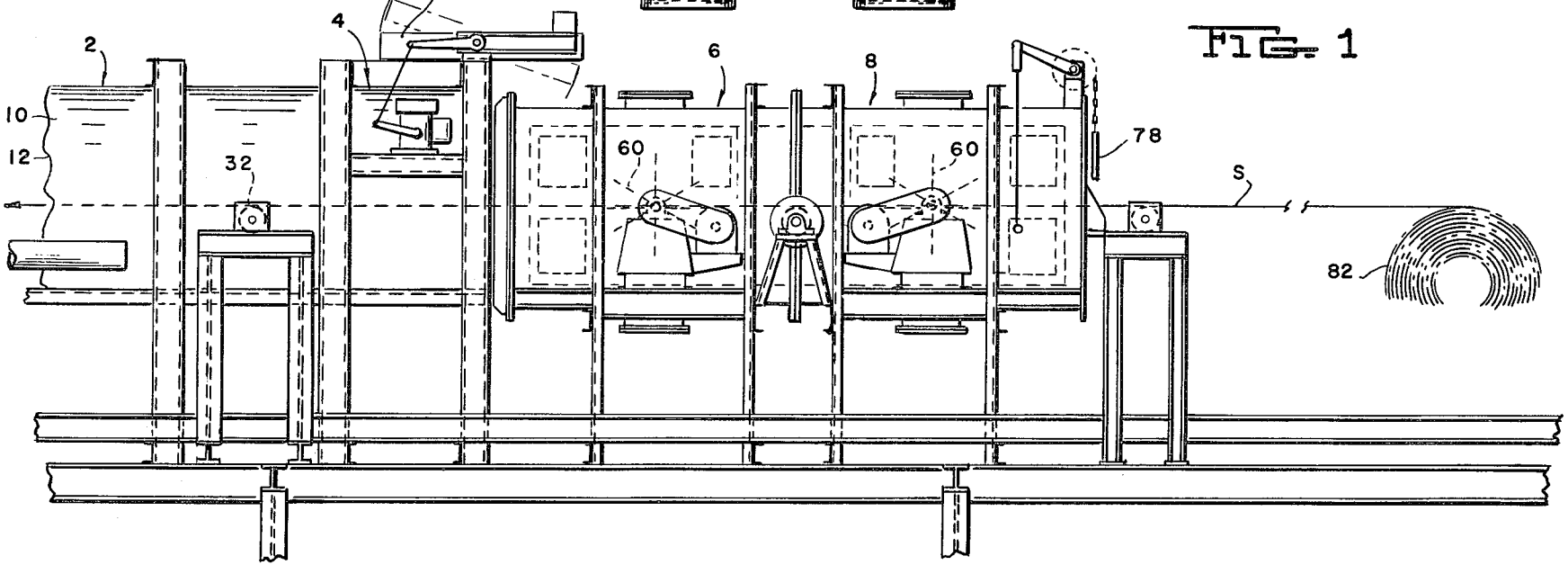
FIG. 1 is a longitudinal elevation of the entry end of the furnace assembly showing my invention.
Figure 3:
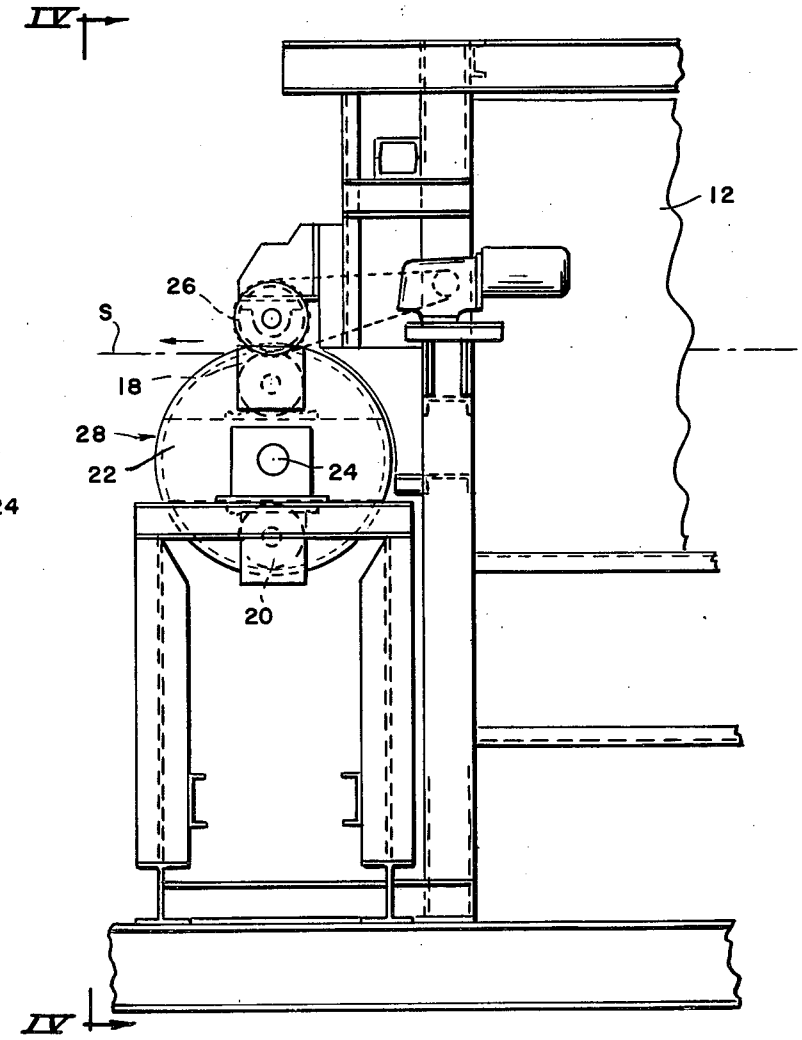
FIG. 3 is an enlarged longitudinal elevation of the exit end of the furnace assembly showing further details of my invention and which with FIG. 1, shows the entire furnace assembly except for the majority of the main furnace section only the ends of which are shown.
Figure 4:
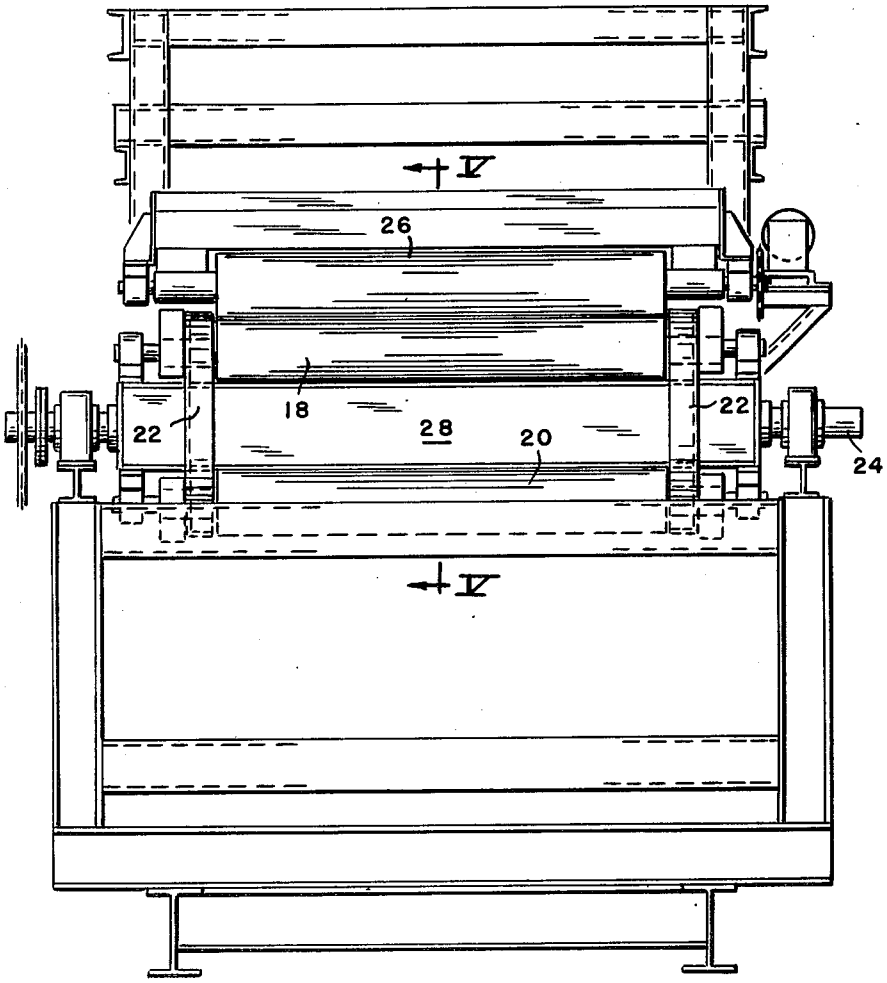
FIG. 4 is a view taken on the line IV—IV of FIG. 3.

Referring more particularly to the drawings, reference numeral 2 indicates the fired or main section of a furnace for heating strip S, such as steel or stainless steel, which passes through the furnace from right to left as shown in FIGS. 1 and 3. This was the only section of the furnace used prior to my invention. According to my invention I provide an intermediate unfired section 4 at the entry end of section 2 and two connected jet recuperators 6 and 8 at the entry end of section 4.

Figures 5, 6, 7, 8, 9:
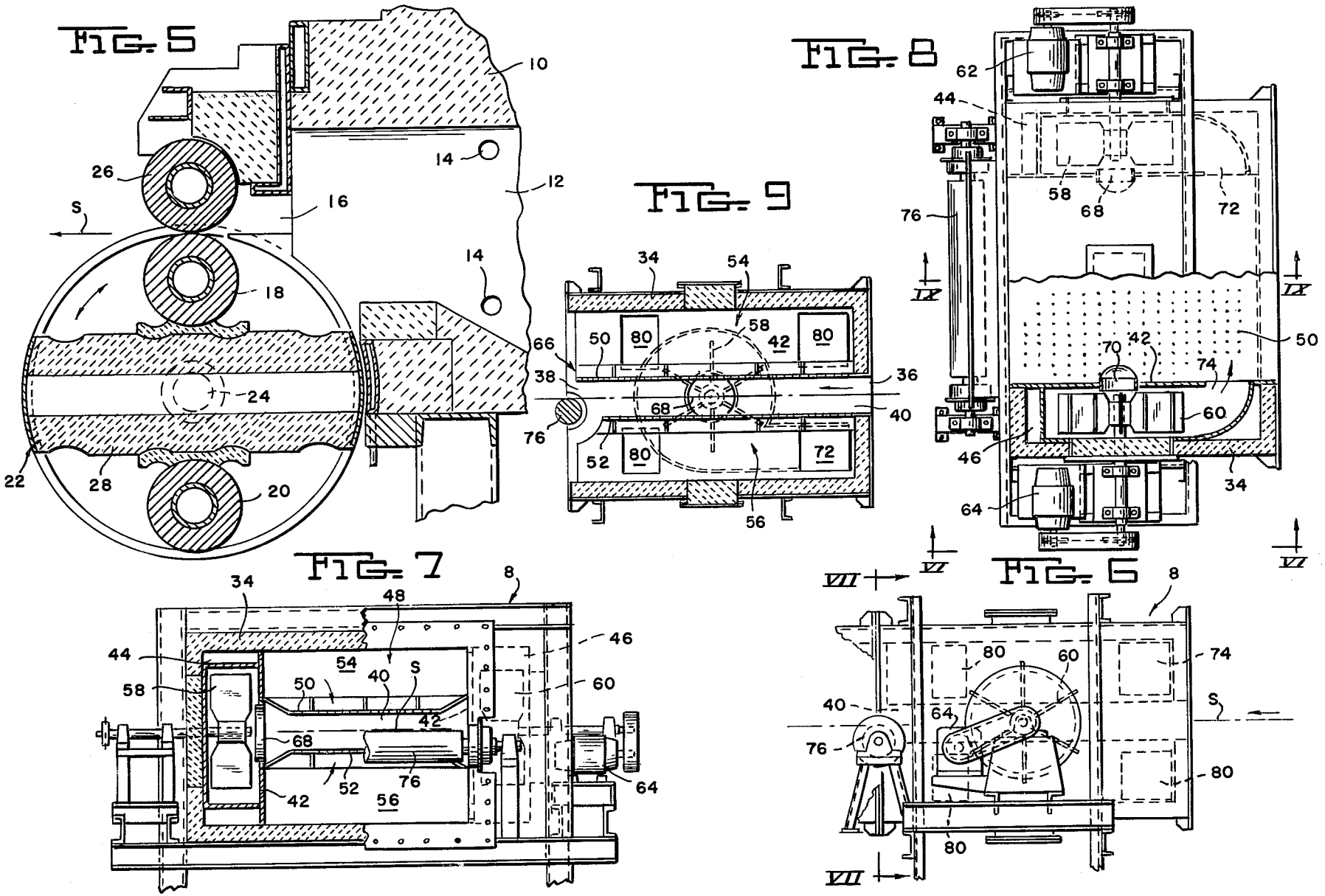
FIG. 5 is a view taken on the line V—V of FIG. 4.
FIG. 6 is a view taken on the line VI—VI of FIG. 8.
FIG. 7 is a view taken on the line VII—VII of FIG. 6.
FIG. 8 is a plan view of the recuperator with parts broken away and shown in section.
FIG. 9 is a view taken on the line IX—IX of FIG. 8.

Section 2 includes a spring refractory arch 10 forming a heating chamber 12. Burners 14 are arranged along the length of section 2 on each side thereof. In the particular embodiment being described the burners are conventional natural gas burners. As best shown in FIG. 5, a discharge opening 16 is provided at the exit end of section 2. A rotatable roll 18 over which strip S passes is provided in opening 16. The roll 18 along with a replacement roll 20 are mounted on a bracket 22 rotatable about the axis of shaft 24. Prior to my invention the waste gases formed by combustion of the natural gas passed into the atmosphere from each end of section 2. The discharge opening was large and open to the atmosphere above and below roll 18. To prevent escape of most of the waste gases, I provide a seal which reduces the area of opening 16 which is open to the atmosphere. This includes a driven roll 26 mounted above and parallel to roll 18 and closely spaced therefrom so as to form a gap only slightly greater than the thickness of strip S. I also provide a refractory wool shield 28 on bracket 22 extending along the length of rolls 18 and 20 which prevents escape of waste gases and also protects roll 20 from the heat. Water cooled shields are provided as required.

The intermediate section 4 is basically the same in cross-section as section 2, but does not have any burners. However, it is provided with a roof damper 30 on the inlet side which is closed except for start-up when no strip is present in the line. A strip supporting roll 32 is provided at the exit end of section 4.

The jet recuperators 6 and 8 have the same construction and only one will be described in detail. Each of the recuperators has refractory walls 34 with end openings 36 and 38 into strip heating chamber 40. Spaced vertical plates 42 divides the recuperator into side sections 44 and 46 and central section 48. Top and bottom perforated plates 50 and 52 extending between plates 42 form the strip heating chamber in section 48 and top waste gas chamber 54 and bottom waste gas chamber 56. The plates 50 and 52 are provided with rows of ¾ inch holes on 3⅜ inch centers. The size and spacing of the holes may vary dependent upon temperature and volume of waste gases. Fans 58 and 60 are arranged in chamber 44 and 46, respectively and are driven by means of motors 62 and 64, respectively located outside of the refractory walls 34. Waste gases from section 4 pass through opening 66 at the exit end of the recuperator and into side sections 44 and 46 through inlets 68 and 70. Fan 58 delivers waste gases through outlet 72 into bottom chamber 56 and through the holes in bottom plate 52 against the bottom of strip S. Fan 60 delivers waste gases through outlet 74 into top chamber 54 and through the holes in top plate 50 against the top of strip S. A strip support roll 76 is provided between recuperators 6 and 8. A sliding door 78 is provided at the entry end of recuperator 8. Holes 80 are provided between chambers 44 and 46 which permit flow from one fan to both top and bottom waste heat chambers 54 and 56 in case the other fan becomes inoperative for any reason.

A strip uncoiler 82 is provided at the entry end of recuperator 8 and a strip coiler at the exit end of furnace section 2. It will be understood that the usual strip accumulators and other strip handling apparatus such as trimmers and welders will be provided in the usual manner, but since these form no part of the present invention, they are not shown. When the furnace is part of a strip annealing line the usual coolers, descalers, etc. will also be provided at the exit end of the furnace.

The chamber of intermediate section 4 is preferably smaller in cross section than that of section 2 to provide better efficiency. The efficiency of the recuperators 6 and 8 is better than that of section 4, but section 4 is provided to bring the temperature of the waste gases down to where they can be handled by the recuperators. In those instances where the temperatures of the fuel gases leaving main furnace section 2 is low enough to be handled by the recuperators, the intermediate section 4 would be omitted. The temperature of the flue gases which may be handled by the recuperators is dependent upon the cost and availability of materials of construction. In the particular recuperator shown and described the main walls are lined with refractories and the metal parts inside the recuperator are made of type 310 stainless steel. The recuperators shown are each 8 feet long and the fans are Garden City Fan and Blower Co. RF2 *Thermal-Aire,* size 19, high temperature fans rated at 10,638 cfm at 14 in S.P. at 70° F. The fans are each driven by a 20 HP, 2 speed 1800/900 rpm motor. While two recuperators are shown one or more than two may be used depending on conditions.

The operation of the apparatus as shown is as follows: The strip S passes from the uncoiler through the recuperators 8 and 6, the section 4 and the section 2 through auxiliary equipment to the coiler. In the first recuperator 8 the strip S is heated from ambient temperature to 430° F with the waste gases being cooled from 1250° to 875° F. The second recuperator 6 heats the strip to 680° F, with the waste gases entering the recuperator at 1700° F. The temperature of the flue gases leaving the main furnace section 2 is approximately 2050° to 2150° F and these gases heat the strip S in the intermediate section to 1090° F. In the main furnace section the strip S is heated to its annealing temperature. Because a substantial amount of the heat from the waste gases is being utilized the burners are being operated at high excess oxygen with resultant high efficiency. It will be understood that the above figures are by way of example only. Since installation of the recuperators and center section 4 the capacity of the furnace has increased approximately 50%. However, various other changes were also made to decrease heat loss, etc. so that not all the improvement can be attributed to the present invention. However, it is estimated that the present invention results in approximately 35% increase in capacity. The present invention has decreased fuel input by about 40% per ton of steel heated.

The damper 30 may be opened during line downtime when no strip is in the line to permit partial or full venting of waste gases.

While the invention is shown and described as relating to a continuous strip heating line it may be used in any line where a workpiece passes through a furnace in the opposite direction to flow of waste gases. In some instances it may be desired to heat only the top or bottom of the workpiece. In those cases only the top or bottom waste gas chamber will be provided with all the waste gases passing through the associated perforated plate.

While only one embodiment has been shown and described in detail, it will be readily apparent to those skilled in the art that various adaptation and modifications may be made within the scope of the invention.

I claim:

1. A method of heating a steel strip which comprises continuously passing uncoiled strip through the heating chamber of a jet recuperator and then through a main heating chamber where heat is provided by burning fuel, preheating the strip in said jet recuperator by taking waste gases from combustion of said fuel through outlet means offset transversely from the center of said recuperator and intermediate the length of said recuperator and forcing said waste gases through spaced holes against the top and bottom of said strip, and then heating the strip to the desired temperature in said main heating chamber.

2. A method of heating a steel strip according to claim 1 in which the strip is given a second preheat by passing it through said waste gases flowing from said heating chamber to said recuperator.

3. Apparatus for heating a workpiece which comprises an elongated main furnace section having a main heating chamber through which the workpiece passes from an entry to an exit end; fuel burners in said main furnace structure; an opening at the entry end of said heating chamber for receiving said workpiece and waste gases from the combustion of said fuel; a jet recuperator at the entry end of said main section having a heating chamber communicating with said main heating chamber and through which the workpiece passes to said heating chamber in said main furnace section, said recuperator including a waste gas chamber communicating with said main heating chamber and having a wall adjacent the path of travel of said workpiece in said recuperator heating chamber with holes therethrough, outlet means from said recuperator heating chamber offset transversely from the center thereof intermediate the length thereof, fan means for receiving waste gases from said main furnace section and said recuperator heating chamber through said offset outlet and delivering them through said waste gas chamber and said holes against said workpiece; and means for moving said workpiece through said heating chambers and exit end of said main furnace section.

4. Apparatus according to claim 3 in which said workpiece travels in a generally horizontal path, said recuperator heating chamber is rectangular in transverse section, and said apparatus includes a pair of outlet means from said recuperator heating chamber, each offset transversely from the center thereof one at one side and the other at the other side of said center and each intermediate the length of said recuperator.

5. Apparatus according to claim 4 in which said recuperator includes two waste gas chambers one below and one above said heating chamber, a top metal wall for the lower waste gas chamber, a bottom metal wall for the upper waste gas chamber, side walls for said recuperator heating chamber, one of said outlet means in each of said side walls intermediate the length thereof, each of said top and bottom walls having a plurality of holes therethrough spaced over the majority of the surface thereof, and fan means on the outside of each of said side walls for receiving waste gases from said main furnace section and said recuperator heating chamber through the associated outlet and delivering them through said waste gas chamber and said holes against said workpiece, a portion of said waste gases then passing from the entry end of said recuperator.

6. Apparatus according to claim 5 including a discharge opening for said workpiece at the exit end of said furnace only slightly larger than said workpiece.

7. Apparatus according to claim 5 including an elongated intermediate furnace section between the main furnace section and said recuperator, and a heating chamber in said intermediate section for receiving said waste gases from said main furnace section and delivering them to said recuperator, said intermediate section being heated solely by said waste gases.

8. Apparatus according to claim 7 including a discharge opening for said workpiece at the exit end of said furnace only slightly larger than said workpiece.

9. Apparatus according to claim 3 including an elongated intermediate furnace section between the main furnace section and said recuperator, and a heating chamber in said intermediate section for receiving said waste gases from said main furnace section and delivering them to said recuperator, said intermediate section being heated solely by said waste gases.

10. Apparatus according to claim 3 including a second jet recuperator at the entry end of said first jet recuperator having a construction similar to said first jet recuperator, and means for delivering said waste gases from said first recuperator to said second recuperator.

11. Apparatus according to claim 10 in which said workpiece travels in a generally horizontal path and each of said recuperators includes two waste gas chambers one below and one above said heating chamber, a top metal wall for the lower waste gas chamber a bottom metal wall for the upper waste gas chamber, side walls for said recuperator heating chamber, outlet means in each of said side walls intermediate the length thereof, each of said top and bottom walls having a plurality of holes therethrough spaced over the majority of the surface thereof, and fan means on the outside of each of said side walls for receiving waste gases from said main furnace section and said recuperator heating chamber through the associated outlet means and delivering them through said waste gas chamber and said holes against said workpiece.

12. Apparatus according to claim 11 including an elongated intermediate furnace section between the main furnace section and said first recuperator, and a heating chamber in said intermediate section for receiving said waste gases from said main furnace section and delivering them to said first recuperator, said intermediate section being heated solely by said waste gases.

13. Apparatus according to claim 12 including a discharge opening for said workpiece at the exit end of said furnace only slightly larger than said workpiece.

14. Apparatus according to claim 3 including a discharge opening for said workpiece at the exit end of said furnace only slightly larger than said workpiece.

* * * * *